US006865776B2

(12) United States Patent
Spinelli

(10) Patent No.: US 6,865,776 B2
(45) Date of Patent: Mar. 15, 2005

(54) MODULAR HANDLE, PARTICULARLY FOR BROOMS AND LIKE

(75) Inventor: Enrico Spinelli, Stabbia-Cerreto Guidi (IT)

(73) Assignee: F.I.M.M. S.p.A., Cerreto Guidi (FI)

( * ) Notice: Subject to any disclaimer, the term of this patent is extended or adjusted under 35 U.S.C. 154(b) by 0 days.

(21) Appl. No.: 10/373,824

(22) Filed: Feb. 25, 2003

(65) Prior Publication Data

US 2003/0163897 A1 Sep. 4, 2003

(30) Foreign Application Priority Data

Mar. 1, 2002 (IT) ..... RM20020042 U

(51) Int. Cl.[7] ..... B25G 1/04

(52) U.S. Cl. ..... 16/110.1; 16/427; 16/429; 403/359.1; 403/377

(58) Field of Search ..... 16/110.1, 111.1, 16/421, 422, 426, 427, 429, 436, 115; 403/17, 19, 222, 227, 298, 359.1, 359.6, 377

(56) References Cited

U.S. PATENT DOCUMENTS 2,653,840 A * 9/1953 Bitzer et al. ..... 403/333
3,380,097 A * 4/1968 Pharris ..... 15/145
3,759,623 A * 9/1973 Hesse ..... 403/298
4,086,718 A * 5/1978 Swanson et al. ..... 43/17.2
4,524,484 A * 6/1985 Graham ..... 16/429
4,768,258 A * 9/1988 Langenstein ..... 16/429
4,819,402 A * 4/1989 Schneider ..... 52/726.1
5,161,278 A * 11/1992 Tomm ..... 15/159.1
5,460,458 A * 10/1995 Caceres ..... 403/109.5
5,515,574 A * 5/1996 Larson ..... 16/429
5,606,761 A * 3/1997 Lynch ..... 15/144.4
5,649,780 A * 7/1997 Schall ..... 403/109.4
5,661,868 A * 9/1997 Panagakos et al. ..... 15/184
5,692,856 A * 12/1997 Newman et al. ..... 403/352
5,887,314 A * 3/1999 Jordan, Jr. ..... 15/144.3
5,983,455 A * 11/1999 Polzin et al. ..... 16/429
6,254,305 B1 * 7/2001 Taylor ..... 403/378
6,390,925 B1 * 5/2002 Perrow ..... 464/111

* cited by examiner

*Primary Examiner*—Robert J. Sandy
*Assistant Examiner*—Andre' L. Jackson
(74) *Attorney, Agent, or Firm*—Dann, Dorfman, Herrell and Skillman; Henry H. Skillman

(57) ABSTRACT

An improved modular handle for a tool having a plurality of handle segments, at least a grasping segment and a support segment for the tool, the segments being provided with either a male end or a female end for coupling to each other by a forced introduction. The male end has a reduced diameter zone with a undulate end section, and the female end having a hollow section with an inner diameter to receive, by a forced coupling, the undulate section of the male end.

12 Claims, 2 Drawing Sheets

MODULAR HANDLE, PARTICULARLY FOR BROOMS AND LIKE

The present invention relates to an improved modular handle, particularly for brooms and like.

More specifically, the invention concerns a handle of the above kind comprised of various parts having a reduced length that can be easily assembled by the user after having purchased the product.

As it is well known, there are available on the market different solutions for modular handles, mainly characterised by costs both compatible with a low price value, said solutions having further an insufficient resistance, beside remarkable mounting difficulties.

Joining of two tubes by threaded, or otherwise coupled, elements, provided at the end of the same, creates an increase of the costs, since they are technically sophisticated.

Even when sufficiently economic solutions are obtained, as in the solution comprising plastic elements, they are characterised by an insufficient resistance.

An optimum coupling system between two tubes can be that providing the "bayonet" coupling, with one end of the tube having a reduced diameter that can be introduced within the end of the other tube.

The above is quite easily obtained by known methods providing the reduction of the tube diameter, forcing the same in a suitable matrix or by a rolling process.

However, these methods have two noticeable limitations: they work only if the material comprising the tube has a sufficient plasticity to be subjected to the required deformation and can further damage the surface, mainly if the tube is lined with plastic resins.

At present, in the production of metallic tubes for brooms handles, in order to reduce the thickness and thus the cost, raw steel laminates are used; therefore, the above tubes have very thin walls (within the range of 0.3–0.4 mm), comprised of high resistance steel with very limited breaking lengthening and deforming limits.

Aiming to reduce the diameter of these tubes, employing standard methods, it could be noted that the wall of the tube couldn't be compressed but collapses curling up without giving the wished result.

A similar problem would be encountered trying to expand the tube, since the reduced lengthening possibility would bring to the breakage before deforming the same as wished.

Consequently, modular handles of the bayonet kind manufactured by the known systems must be realised employing a milder and thicker steel tube to allow the proper deformation and also to compensate the lower resistance of the steel, this involving a rise of costs.

To apply this method, it must be excluded the use of the tube lining made up of plastic resins, being thus necessary to employ furnace paints, applied after the deformation phase with a further increase of costs.

In view of the above, the Applicant has realised a technical solution allowing to manufacture a modular handle able to obviate to the above mentioned drawbacks.

Main object of the present invention is that of providing a product having excellent resistance features, good esthetical features, ease of assembling, accident safety, the above with a very low manufacturing cost.

Further object of the present invention is that of providing a handle provided with a type of coupling allowing assembling the various parts comprising the handle, making them integral each other.

It is therefore specific object of the present invention an improved modular handle, particularly for brooms and like, characterised in that it is comprised of a plurality of handle parts or segments, and particularly at least a initial part or grasping segment and at least a finale part or segment for coupling the tool to be handled, said handle parts or segments being provided with a male end and/or a female end, coupling each other by a forced introduction, said male end providing at least a reduced diameter zone with a undulate section, the diameter of which is equal to the circumference of the handle, said section being obtained by deformation of the end of the part or segment of the same handle, and said female end having an inner diameter to receive, by a forced coupling, said undulate section male end.

The undulate section is provided by providing the hollow end of the male member with a perimeter composed of alternating concave and convex arcuate walls to provide a series of continuously curving undulations extending parallel to the longitudinal axis of the male member.

Particularly, according to the invention, said handle can also be comprised only by the two above mentioned parts, but more often it will provide one or more intermediate parts or segments, each one provided with male end and/or female end, coupling with respective female and male ends provided on the adjacent parts.

Always according to the invention, said reduced diameter section of the male end has shape and dimension slightly growing or slightly conical.

Still according to the invention, said reduced diameter zone of the male end has two zones having different diameter, the greater diameter being in the zone farther from the end.

Furthermore, according to the invention, said undulate section male end is realised making the end passing the end of the part or segment within an apparatus provided with various shaped rolls, provided a dial configuration and having the rotation axis laying on a plane perpendicular to the axis of the part or segment.

As an alternative, said undulate section male end is realised tightening said end by an apparatus provided with dial configurated jaws and provided with a contemporaneous motion toward the centre of the same.

Furthermore, the handle according to the invention can be realised employing bare tubes, or tubes coated with a plastic film, or painted tubes, or in any case tubes having a surface finishing not damaged by the diameter reduction step.

In an embodiment of the handle, said female end is protected by a ring partially inserted on the same in such a way that the terminal part of the tube is within the same ring, said ring possibly providing a groove to house an outward riveting necessary to promote the insertion of the male end and that could be realised by a suitable punch after the mounting of the ring.

Particularly, according to the invention, said ring for the protection of the female end has a very thin thickness and rounded shape so as to create the minimum discontinuity on the assembled handle.

Furthermore, according to the invention, said ring for the protection of the female end can have dimensions bigger than those necessary for its operation, thus realising a knob making the handgrip of the handle easier, a hook for fittings, and like.

Said ring is preferably comprised of a resistant material, particularly of metal, in such a way to have, beyond the esthetical and safety function, also a reinforce function of the female end.

The present invention will be now described, for illustrative but not limitative purposes, according to its preferred embodiments, with particular reference to the figures of the enclosed drawings, wherein.

Figure 1:
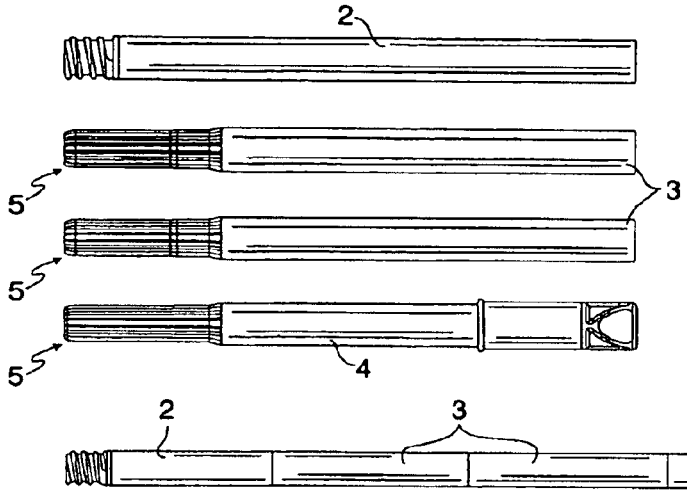
FIG. 1 is an elevation side view of an embodiment of a handle according to the invention disassembled.
Figure 2:
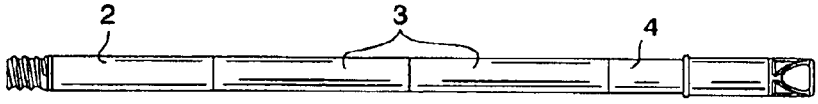
FIG. 2 is an elevation side view of the handle of FIG. 1 assembled.

Making now reference to the figures of the enclosed drawings, it is shown a handle 1 according to the invention, comprised of four elongated hollow parts, respectively a first lower end part 2, two intermediate parts 3, and an upper end part 5 (see FIG. 1). In FIG. 2, it is shown the handle 1 after its assembly by forced longitudinal coupling of the parts.

Figure 3:
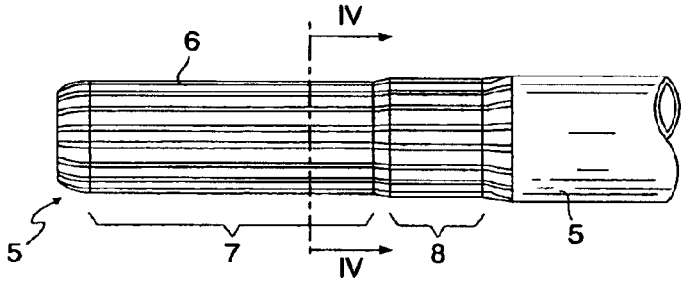
FIG. 3 is an elevation side view of a particular of the end of one of the elements comprising the handle of FIG. 1.
Figure 4:
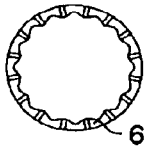
FIG. 4 is a section view taken along line IV—IV of FIG. 3.

In FIGS. 3 and 4, it is shown the coupling system used according to the invention for coupling the various parts 2, 3, 4 of the handle 1. Specifically, FIG. 3 illustrates the end 5 of one of any one of the parts 2, 3, 4, having a reduced diameter, the section of which is shown in FIG. 4.

It can be seen that end 5 is provided with relieves or concave walls 6, the number and shape of which can vary in function of the specific needing, it being essential that the diameter of the imaginary circle which circumscribes the perimeter of the undulate section is almost identical to the diameter of the interior circumference of the tube 2 (or 3 or 4).

The same applies also in case the section of tube 2 (or 3 or 4) is not rounded, but different, and the undulate deformation from which the reduced diameter end is obtained will not have to involve drawing or compression of the wall of the tube comprising the handle 1 according to the invention.

In case the reduced diameter part of the part 5 has two different diameters, the terminal end 7 (i.e. faced toward the coupling with the corresponding part of the handle 1 remote from the body segment of the part 5) will have a reduced diameter precisely coupling without any effort with the other part, while the part 8 adjoining the body segment will have bigger diameter provides a forced coupling.

Even if the diameter difference between the parts 7 and 8 is exaggerated in the drawing for better clarity, really it is very little and not appreciable with the naked eye.

Notwithstanding the methods to obtain the deformation are not specific object of the present invention, in the following some of them will be described for illustrative, but not limitative reasons.

Figure 5:
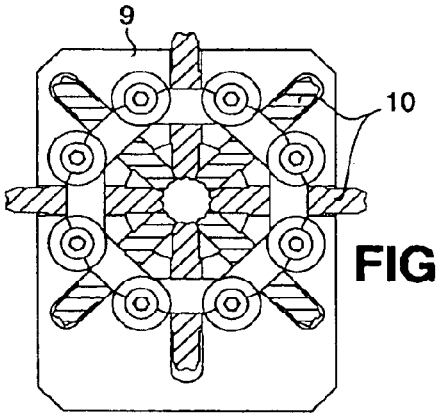
FIG. 5 is a schematic view of a first method to realise a handle according to the invention.

In the roll method shown in FIG. 5 it is provided a head 9 with the suitable number of rolls 10, the profile of which is undulate as it is the final profile of the terminal ends of the parts 2, 3, 4 to be obtained.

It will be sufficient to introduce and thrust parts 2, 3 or 4 within said head 9, for the wished stoke, and then withdraw the same, so that the end 5 passed through the rolls 10 will be suitably deformed.

In order to improve the precision, it can be convenient to put inside a core having a suitable undulate profile. To obtain the two different diameters for the portions 7 and 8 of the end 5, it is possible to realise the two rolls 10 with a variable profile or making two runs through two different heads 9.

Operation of rolls will be very smooth and gradual, in such a way not to damage the surface of the tube, even if coated with plastic resins; further the operation and the apparatus are really simple.

Figure 6:
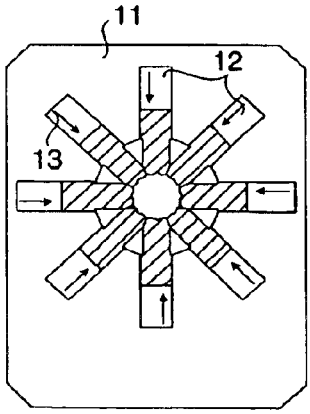
FIG. 6 is a schematic view of a second method to realise a handle according to the invention.

In FIG. 6 it is shown a method providing the use of a head 11 with jaws 12, having a linear or oscillating movement according to the direction of arrows 13.

Said jaws 12 have such a useful length corresponding to that of the end part 7, 8 to be deformed, thus, once introduced the part 2, 3 or 4 within the head 11, jaws 12 close all together realising the final profile.

In this case too it can be used the inner core to improve the result.

In this case too the deformation is gradual and the surface is not stressed too much.

As already said, other apparatuses can be used to obtain the handle according to the invention.

All the coupling systems presently used to make broom handles comprised of parts must provide some solutions to make the coupling point both aesthetically acceptable and without corners that could be a danger for the user when the assembling operation is carried and during normal use of the handle. The alternating concave and convex arcuate walls provide continuously curving undulations as shown in figure 6, and avoid the presence of sharp corners in the male end section.

The bayonet system satisfies rather well these requisites, however the end of the female tube is rather dangerous, having sharp, and also slightly projecting outward, corners to create the inner mouthpiece suitable to receive the male tube.

By the solution according to the present invention, being it possible to advantageously receive a thin tube, this danger could be more relevant, so that it has been provided a simple system to completely pass it, being the same applicable also to traditional solutions.

Figure 7:
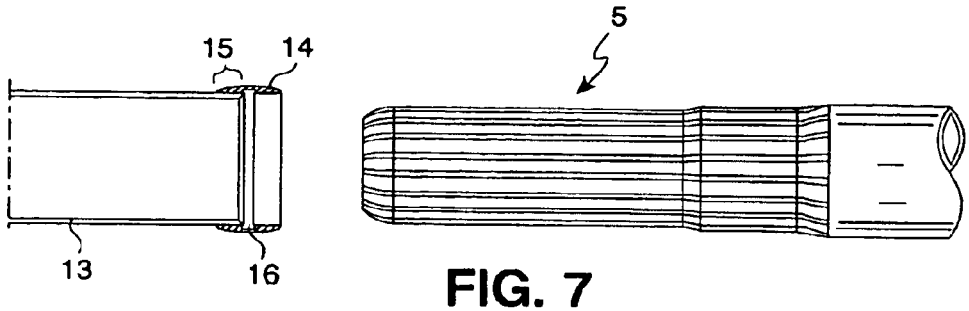
FIG. 7 is an exploded, partially in section, view of a coupling of a handle according to the invention.

FIG. 7 shows the female end 13 of part 2, 3 or 4, protected by a ring 14, the zone 15 of which is forced on the female end 13 of the part 2, 3 or 4 of the handle 1 according to the invention.

After the partial introduction of the ring 14 on the part 2, 3 or 4, by a suitable punch, mouthpiece 16 is realised, said mouthpiece at the same time firmly blocking the ring in this position.

Figure 8:
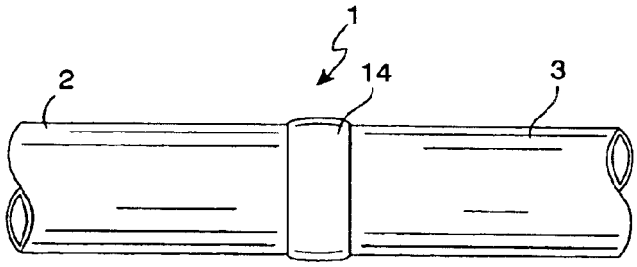
FIG. 8 is an elevation side view of a first coupling for a handle according to the invention.

In this way, potentially dangerous part is completely covered and the two coupled parts are as illustrated in FIG. 8.

Ring 14 will preferably be thin and rounded in such a way to create the minimum possible discontinuity, its shape and dimensions not being important for the invention.

Figure 9:
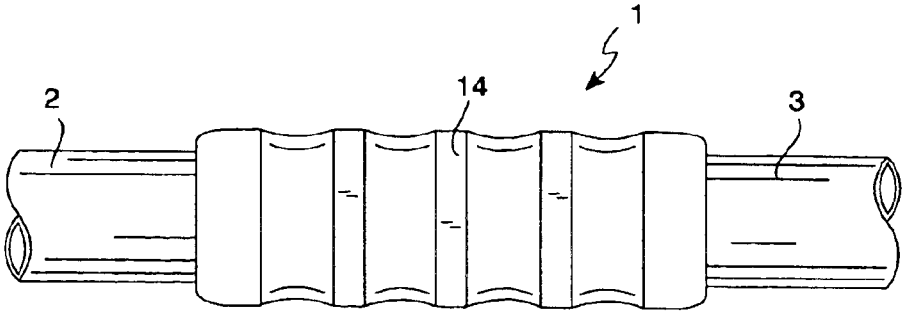
FIG. 9 is an elevation side view of a second coupling for a handle according to the invention.

Finally, in FIG. 9 it is shown a different handle 1 according to the invention, wherein said ring 14 has an exaggerated dimension up to realising a knob that can improve the use of the handle 1 for particular uses.

Ring 14, in its simpler form has a very low cost, being it possible to realise it by plastics. However, it could also be comprised of metal, thus obtaining also the reinforcement of the female end 13, that is the most stressed part during the use, being thus possible to further reduce the thickness, maintaining the same performances.

The solution at the base of the present invention provides the reduction of the outer diameter of the tube, modifying its profile in such a way to maintain unchanged the perimeter, without creating sharp corners.

In this way it is not necessary that the material is subjected to a remarkable plastic deformation, being necessary only curvatures that, also thanks to the reduced thickness of the tube wall, can be easily tolerate by the material.

New profile obtained can have an undulate shape inscribed within a circle having diameter corresponding to the inner diameter of the tube; the tube portion can thus introduce within another equal tube, thus creating a connection with remarkable mechanical features.

Deformation induced is not so drastic and requires reduced stresses, so that, even if the tube is coated by plastic resins, surface is not damaged by the operation.

In this way, it can be easily used the same kind of tube used for the standard handles in a single piece.

Coupling between the single tube elements must be forced so as the two pieces cannot be easily dismounted. To this end, the part having a reduced diameter can have a slightly conical shape, or it can have two zones with different diameters, the first one of which allows an easy manufacturing, and the second one allows to realise the wished forced mounting. By the term "diameter" as used in the preceding specification it is meant, not being the section circular, "the diameter of the circle circumscribed to the tube profile".

In conclusion, it is well evident that a handle realised according to the teachings of the present invention has optimum resistance features, comparable to those of a whole tube, since a penetration is realised with a forced coupling between the various sections.

Further, manufacturing cost is reduced, not being necessary to provide further parts, but only a deformation of the tubes.

Also the mounting of the handle according to the invention by the user is easy and intuitive: in fact, it is sufficient to insert the various sections one into the other until they can be easily introduced by hand, thus the handle must be beated against the floor, keeping it in a vertical position to obtain a forced coupling said coupling not being disassembled unless one wants to disassemble the same, with a remarkable stress.

The present invention has been described for illustrative but not limitative purposes, according to its preferred embodiments, but it is to be understood that modifications and/or changes can be introduced by those skilled in the art without departing from the relevant scope as defined in the enclosed claims.

What is claim is:

1. Improved modular hollow handle, particularly for brooms, characterised in that it is comprised of a plurality of elongated hollow handle parts including at least an initial part and at least a finale part for coupling the tool to be handled, said handle parts being respectively provided with a male end and a female end, coupling each other by a forced longitudinal introduction, said male end providing at least a reduced diameter zone with an undulate section, having a continuously curving concave and convex arcuate wall extending parallel to the longitudinal axis of the male member, the diameter of said undulate section being equal to the hollow circumference of the handle, said section being characterised by deformation of the end of the part of the same handle, and said female end having an inner diameter dimensioned to receive, by a forced longitudinal coupling, said undulate section male end.

2. Improved modular handle according to claim 1, characterised in that it comprises at least one intermediate part, provided with both male and female ends, coupling with respective female and male ends provided on the adjacent handle parts for coupling said intermediate part to said adjacent parts.

3. Improved modular handle according to claim 1, characterised in that the handle parts comprise tubes selected from a group comprising bare tubes, or tubes coated with a plastic film, or painted tubes, or tubes having a surface finish not damaged by a diameter-reduction step which does not involve a lengthening or compression of the material.

4. Improved modular handle according to claim 1, characterised in that said reduced diameter section of the male end extends beyond the body segment of the part, and has a terminal end smaller in transverse cross section than the reduced diameter section adjoining said body segment.

5. Improved modular handle according to claim 4, characterised in that said reduced diameter section of the male end has two zones having different diameters, the greater diameter being in the zone adjoining the body segment, and the smaller diameter being the terminal end.

6. Improved modular handle according to claim 4, characterised in that said reduced diameter section of the male end has a cross sectional shape and dimension slightly growing from the terminal end towards the body segment of the part.

7. Improved modular handle according to claim 1, characterised in that said female end has a ring enclosing the terminal end of the tube and extending beyond the terminal end, said ring having an internal circumferential groove registering with the terminal end of the tube, said end being outwardly flared into the groove to promote the insertion of the male end and to anchor the sleeve on the female end.

8. Improved modular handle according to claim 7, characterised in that said ring far the protection of the female end has a very thin thickness and rounded shape so as to create the minimum discontinuity on the assembled handle.

9. Improved modular handle according to claim 7, characterised in that said ring for the protection of the female end has dimensions bigger than those necessary for its operation, thus realising a knob making the handgrip of the handle easier and providing a grip for fittings.

10. Improved modular handle according to claim 7, characterised in that said ring is comprised of a metal to provide in addition to the esthetical and safety functions, also a reinforcing function to the female end.

11. A method of making an improved modular handle comprised of a plurality of elongated hollow handle parts, and including at least an initial part and at least a final part for coupling the tool to be handled, said handle parts being respectively provided with a male end and a female end, said parts being coupled to each other by a forced longitudinal introduction, said male end providing at least a reduced diameter zone with an undulate section having a continuously curving concave and convex arcuate walls extending parallel to the longitudinal axis of the male member, said hollow female end having an inner diameter dimensioned to receive, by a forced longitudinal coupling, said undulate section male end, the diameter of said undulate section being equal to the hollow circumference of the female section, forming said undulate section male end by passing the end of the part within an apparatus provided with various shaped rolls, having the rotation axis laying on a plane perpendicular to the axis of the part.

12. A method of making an improved modular handle comprised of a plurality of elongated hollow handle parts, and including at least an initial part and at least a final part for coupling the tool to be handled, said handle parts being respectively provided with a male end and a female end, said parts being coupled to each other by a forced longitudinal introduction, said male end providing at least a reduced diameter zone with an undulate section having a continuously curving concave and convex arcuate walls extending parallel to the longitudinal axis of the male member, said hollow female end having an inner diameter dimensioned to receive, by a forced longitudinal coupling, said undulate section male end, the diameter of said undulate section being equal to the hollow circumference of the female section, forming said undulate section male end by tightening said end by an apparatus provided with dial configurated jaws and provided with a contemporaneous motion toward the centre of the same.

* * * * *